US009456634B2

(12) United States Patent
Wang et al.

(10) Patent No.: US 9,456,634 B2
(45) Date of Patent: Oct. 4, 2016

(54) VAPOR GENERATOR

(71) Applicant: Shanghai Green Vaper Technology Co., Ltd

(72) Inventors: Dan Wang, Shenzhen (CN); Yanmin Nie, Shenzhen (CN)

( * ) Notice: Subject to any disclaimer, the term of this patent is extended or adjusted under 35 U.S.C. 154(b) by 179 days.

(21) Appl. No.: 14/541,945

(22) Filed: Nov. 14, 2014

(65) Prior Publication Data

US 2016/0135502 A1 May 19, 2016

(51) Int. Cl.
*A24F 47/00* (2006.01)
*B01F 3/04* (2006.01)

(52) U.S. Cl.
CPC ..... *A24F 47/008* (2013.01); *B01F 3/04085* (2013.01)

(58) Field of Classification Search
CPC ..... B01F 3/04; B01F 3/04085; A24F 47/008
USPC ..... 261/30, 107, 142
See application file for complete search history.

(56) References Cited

U.S. PATENT DOCUMENTS

2015/0027470 A1* 1/2015 Kane ..... A24F 47/008 131/329

* cited by examiner

*Primary Examiner* — Robert A Hopkins
(74) *Attorney, Agent, or Firm* — Clement Cheng

(57) ABSTRACT

A vapor generator has a battery module. The battery module has a battery adapter socket at an end of the battery module. The battery adapter socket has a battery adapter socket first electrical contact and a battery adapter socket second electrical contact. A vapor module is connected to the battery adapter socket. The vapor module comprises a vapor module outside tube. A vapor module inside tube is mounted within the vapor module outside tube. The vapor module inside tube has an inside tube first electrical contact, and an inside tube second electrical contact. The inside tube first electrical contact is insulated from the inside tube second electrical contact. A heater coil is installed inside the vapor module inside tube. The inside tube first electrical contact contacts the battery adapter socket first electrical contact.

16 Claims, 6 Drawing Sheets

VAPOR GENERATOR

FIELD OF THE INVENTION

The present invention is in the field of vapor generators.

DISCUSSION OF RELATED ART

A variety of vapor generators offer an electronic cigarette alternative to traditional cigarettes. The vapor generators have had a variety of different configurations and have been battery powered.

SUMMARY OF THE INVENTION

A vapor generator has a battery module. The battery module has a battery adapter socket at an end of the battery module. The battery adapter socket has a battery adapter socket first electrical contact and a battery adapter socket second electrical contact. A vapor module is connected to the battery adapter socket. The vapor module comprises a vapor module outside tube. A vapor module inside tube is mounted within the vapor module outside tube. The vapor module inside tube has an inside tube first electrical contact, and an inside tube second electrical contact. The inside tube first electrical contact is insulated from the inside tube second electrical contact. A heater coil is installed inside the vapor module inside tube. The inside tube first electrical contact contacts the battery adapter socket first electrical contact, and the inside tube second electrical contact contacts the battery adapter socket second electrical contact when the heater coil is in electrical connection with the battery.

An outlet module connects to the vapor module. The outlet module has an outlet plunger. The outlet plunger is electrically connected to the vapor module outside tube. The vapor module outside tube is electrically connected to the second battery contact. The outlet plunger is mounted to translate on the outlet module so that the outlet plunger has an engaged position that contacts the inside tube second electrical contact to activate the heater coil. The outlet plunger has a disengaged position when the outlet plunger does not contact the inside tube second electrical contact. The outlet module is both an electrical switch and a physical valve. The outlet module further includes an outlet opening that makes a fluid connection with an outlet of the vapor module inside tube when the outlet module is in the engaged position. Optionally, the vapor module outside tube has at least one air inlet disposed on a sidewall of the vapor module outside tube. The vapor module inside tube can have a second heater coil and a heater coil gap disposed on a sidewall of the vapor module inside tube. The vapor module inside tube can have a second heater coil. A heater coil gap can be is disposed on a sidewall of the vapor module inside tube. The vapor module inside tube can also have a wick strand passing across the heater coil, and a wick wrapper wrapping around the wick strand. The vapor module inside tube is preferably insulated from the vapor module outside tube at an outside tube insulator formed on the outside tube, and also at an inside tube seal formed on the inside tube. The vapor module inside tube is secured to the vapor module outside tube using an inside tube plastic nut. The vapor module outside tube has a heater coil cover with a heater coil cover top surface. The heater coil cover top surface makes electrical connection with an outlet plunger inside flange formed on the outlet plunger.

Figure 1:
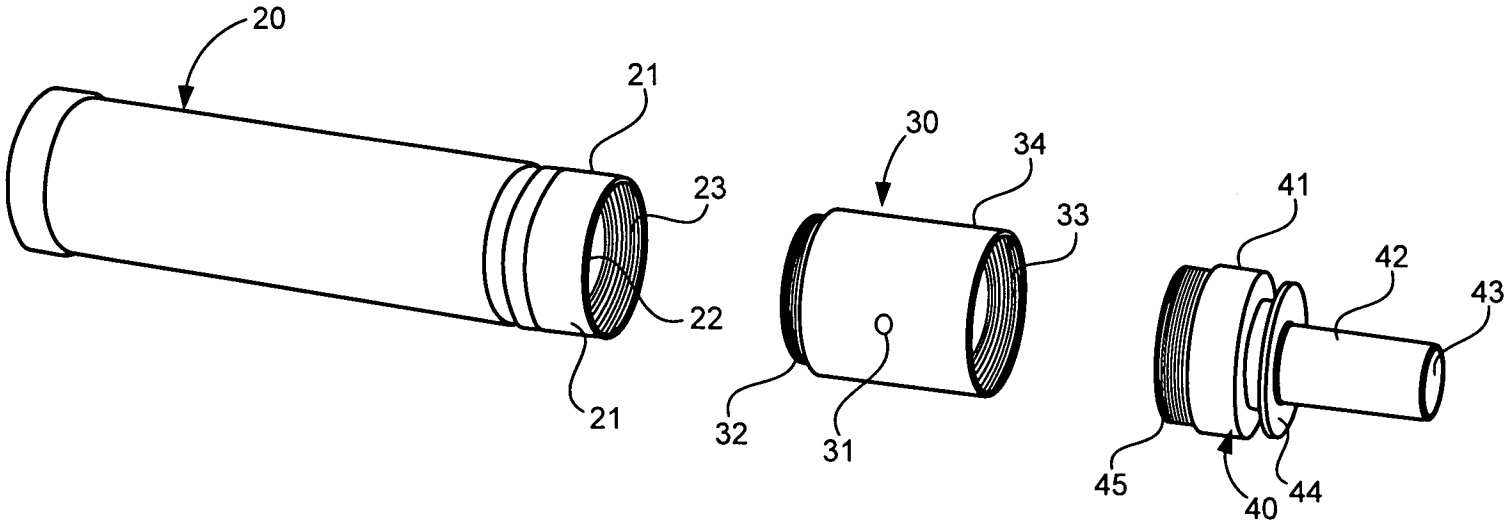
FIG. 1 is a front exploded view of the present invention.
Figure 2:
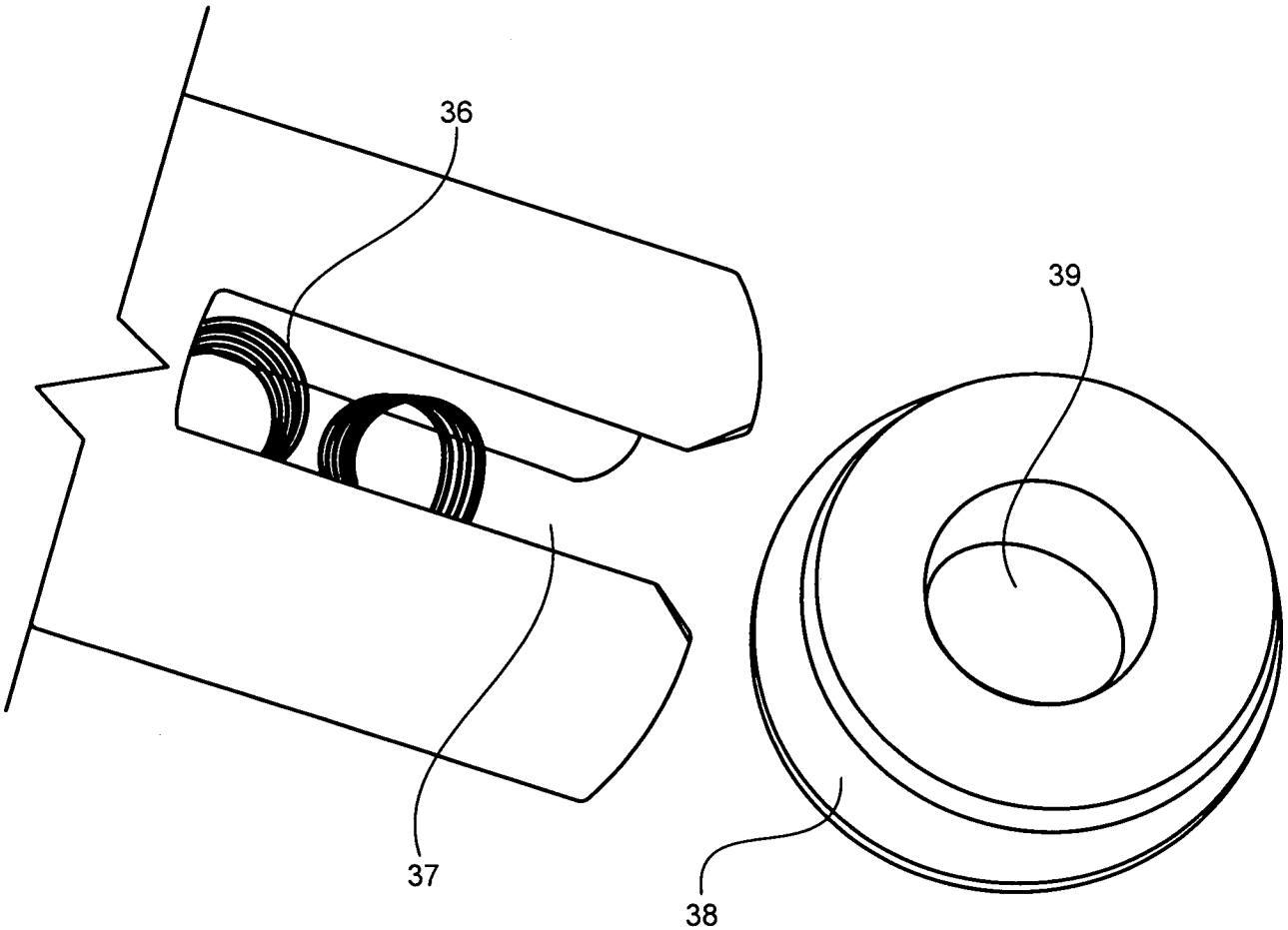
FIG. 2 is a close-up view of the vapor module inside tube.
Figure 3:
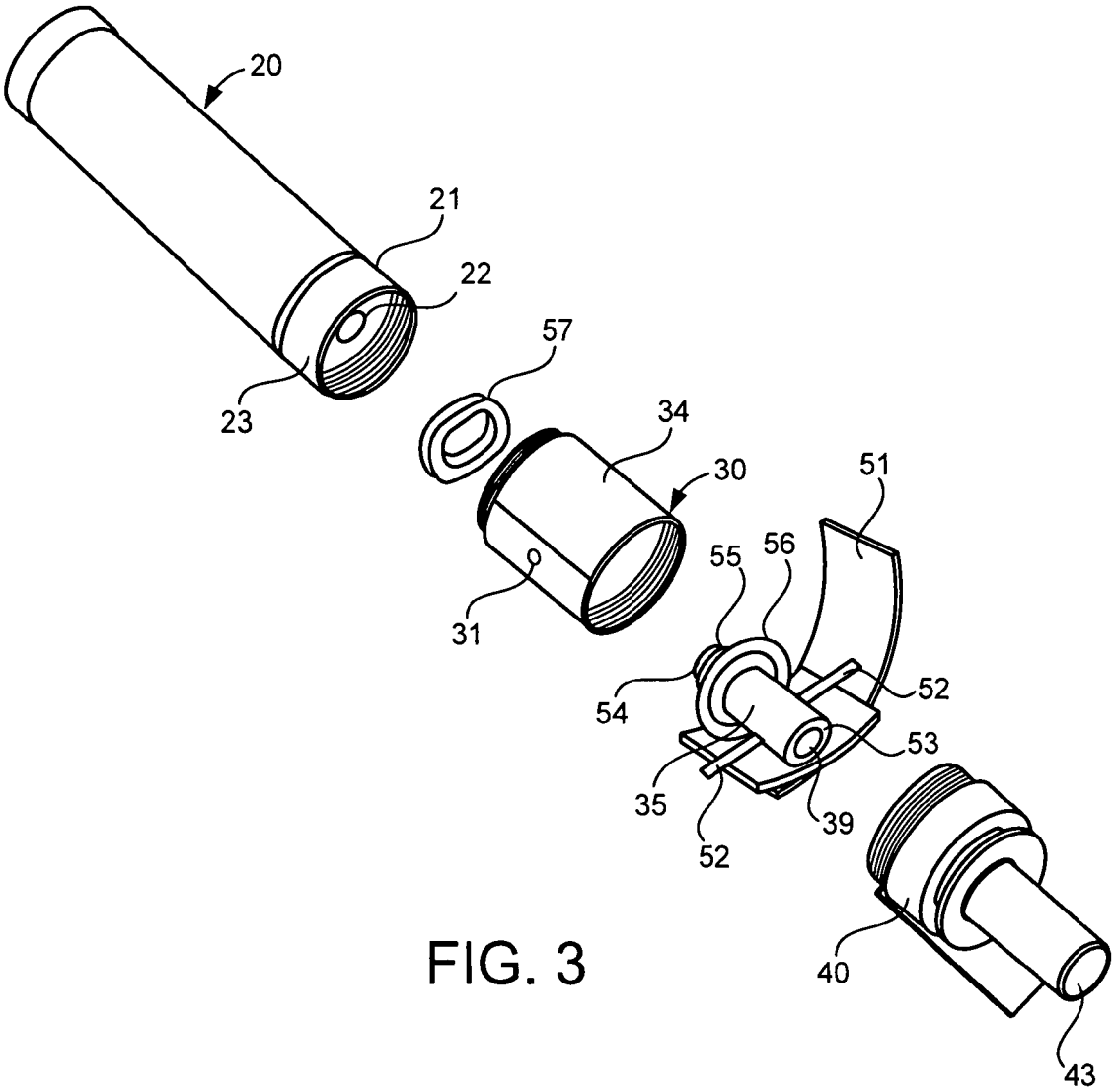
FIG. 3 is a front exploded view of the present invention with an exploded view of the vapor module inside tube.
Figure 4:
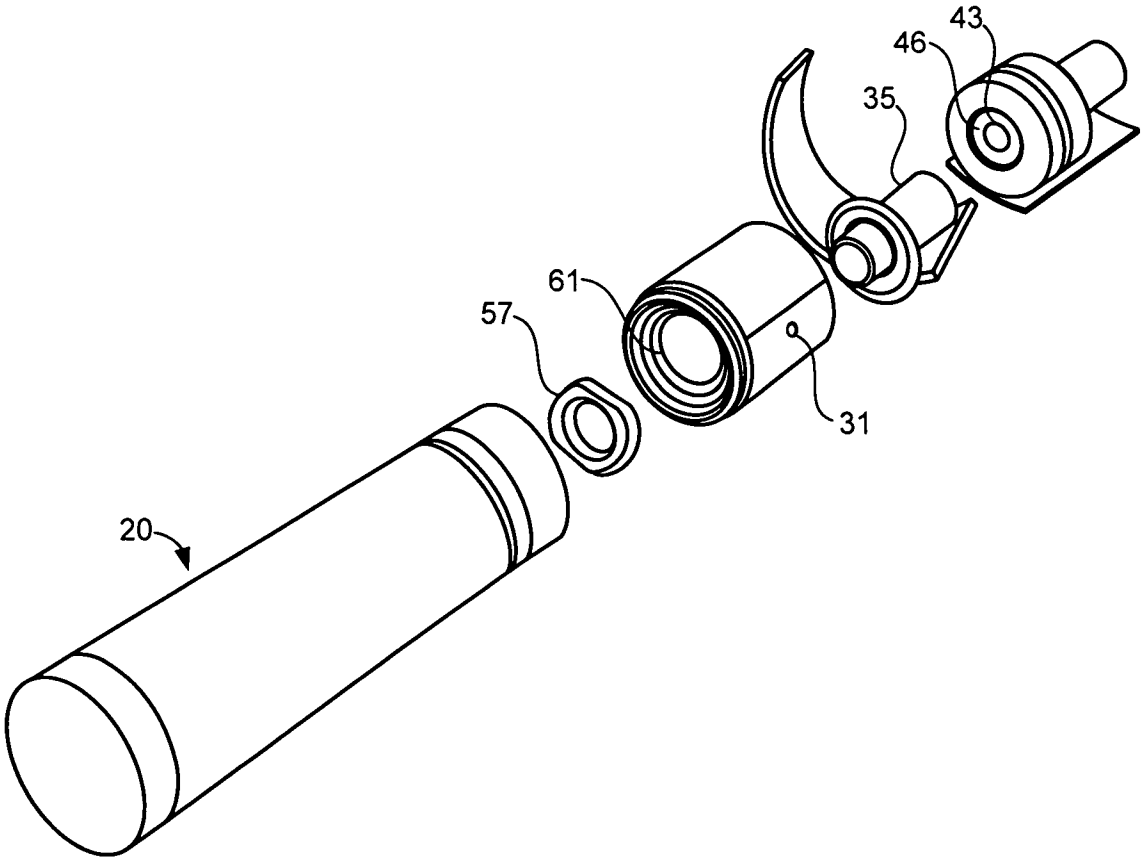
FIG. 4 is a rear exploded view of the present invention with an exploded view of the vapor module inside tube.
Figure 5:
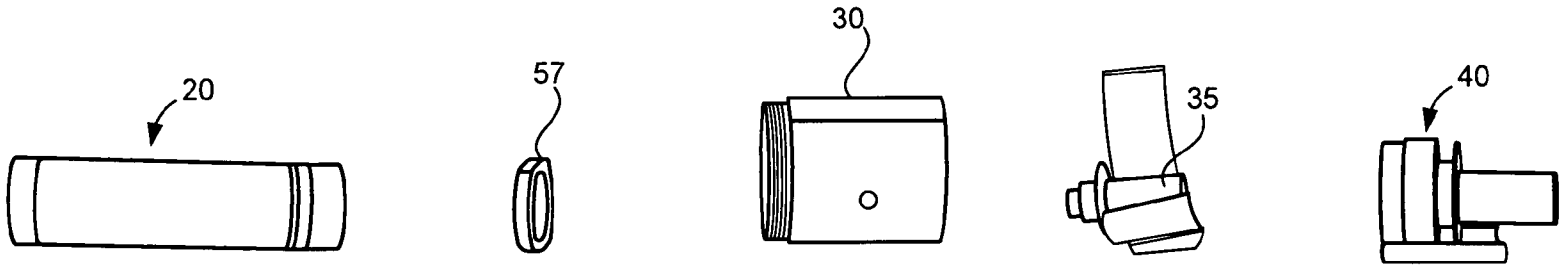
FIG. 5 is a side exploded view of the present invention.
Figure 6:
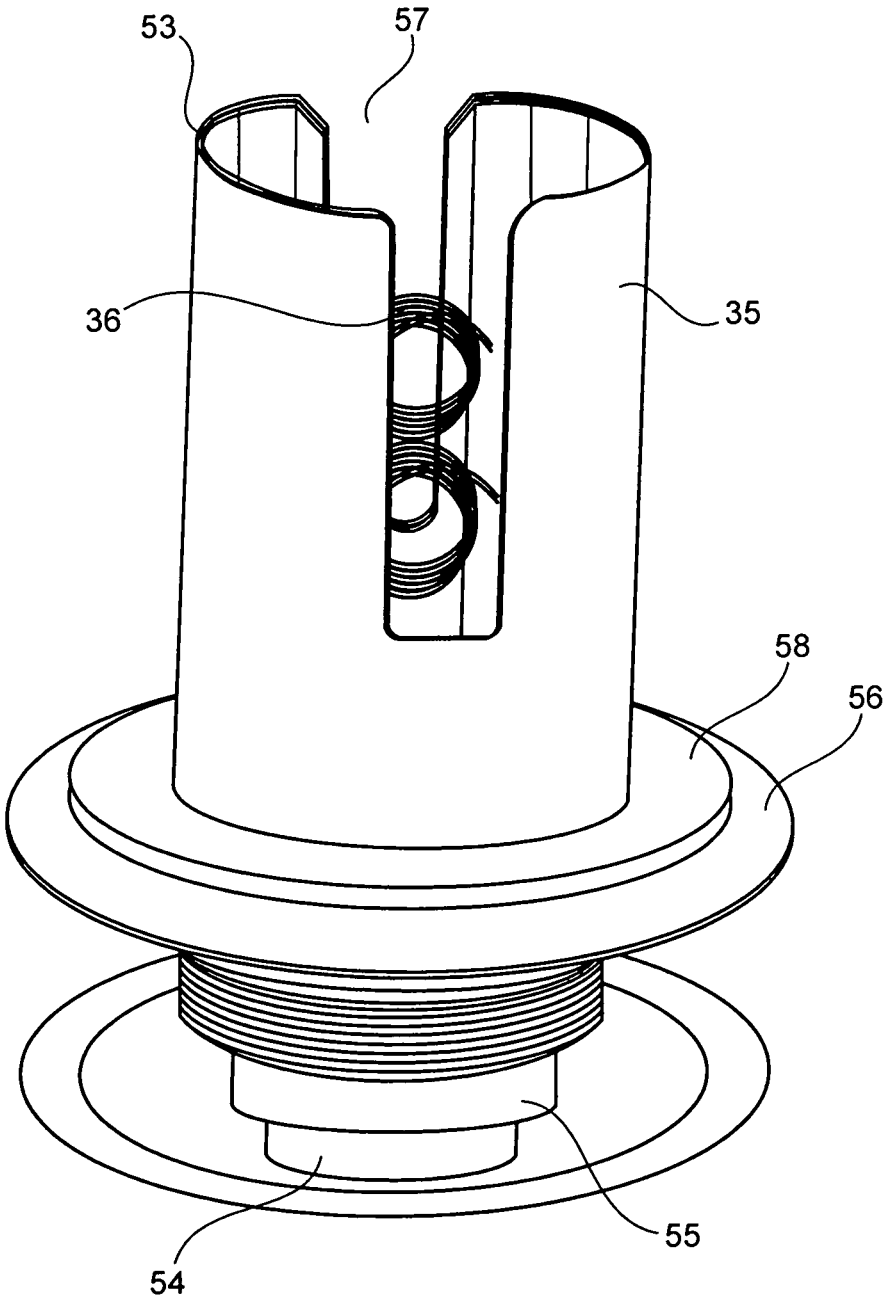
FIG. 6 is a front close-up view of the vapor module inside tube.

The following call out list of elements can be a useful guide in referencing the elements of the drawings.

20 Battery Module
21 Battery Adapter Socket
22 First Battery Contact
23 Second Battery Contact
30 Vapor Module
31 Air Inlet
32 Vapor Module Battery Thread
33 Vapor Module Outlet Thread
34 Vapor Module Outside Tube
35 Vapor Module Inside Tube
36 Heater Coil
37 Heater Coil Gap
38 Heater Coil Cover
39 Heater Coil Cover Let
40 Outlet Tube
41 Outlet Base
42 Outlet Plunger
43 Outlet Opening
44 Outlet Plunger Outside Flange
45 Outlet Base Thread
46 Outlet Plunger Inside Flange
51 Wick Wrapper
53 Inside Tube Second Electrical Contact
54 Inside Tube First Electrical Contact
55 Inside Tube Insulator
56 Inside Tube Seal
57 Inside Tube Plastic Nut
58 Inside Tube Seal Flange
61 Outside Tube Insulator

DETAILED DESCRIPTION OF THE PREFERRED EMBODIMENT

The present invention includes a battery module 20, a vapor module 30, and an outlet module 40. The battery module 20 is connected to the vapor module 30 which is connected to the outlet module 40. The battery module 20 is connected to the vapor module 30 preferably at a battery adapter socket 21. The battery adapter socket 21 preferably has a threaded surface for an internal thread that makes a threaded connection with a vapor module battery thread 32 that is formed on an exterior surface of the vapor module 30. The vapor module 30 has a vapor module outlet thread 33. The vapor module outlet thread 33 is preferably formed on an inside surface of the vapor module 30. The vapor module outlet thread 33 preferably makes a threaded connection with an outside base thread 45 of the outlet module 40. The present invention vapor generator breaks down modularly into three parts for cleaning and maintenance.

The battery module 20 has a battery located within it, and the battery can be a nickel metal hydride or NiCad battery. The battery should be a rechargeable battery. The battery adapter socket 21 preferably has a first battery contact 22 and a second battery contact 23. The first battery contact 22 is formed as a metal circular disc insulated from the second battery contact 23. The inside tube can have a threaded surface so that it makes a threaded connection with the outside tube. The first battery contact 22 is surrounded by the second battery contact 23 so that the outside circumference of the first battery contact 22 is bounded by the inside circumference of the second battery contact 23. The second battery contact 23 as a ring shape with a circular opening where the first battery contact 22 is located. The first battery contact 22 is insulated from the second battery contact 23 at a battery contact insulator. The battery contact insulator can be formed as a ring shaped plastic member.

The vapor module 30 has at least one air inlet 31 preferably formed on a sidewall of the vapor module 30. The air inlet 31 can be a circular opening that is formed in the steel tube of the vapor module 30. The sidewall of the vapor module 30 is preferably configured as the vapor module outside tube 34. The vapor module outside tube has an inside surface of which a portion forms the vapor module outlet thread 33.

The outlet module 40 has an outlet base 41 and an outlet plunger 42 that is mounted to the outlet base 41 so that the outlet plunger 42 can slide relative to the outlet base 41 from an engaged position to a neutral position. The outlet opening 43 passes through the outlet plunger 42. The outlet plunger 42 has a shaft that terminates at a tip, and has an outlet plunger outside flange 44 near the outlet base 41. When a user pushes down on the outlet plunger 42, the outlet plunger inside flange 46 of the outlet plunger 42 abuts the heater coil cover 38. The heater coil cover 38 has an opening, which is the heater coil cover outlet 39. The heater coil cover outlet 39 is the outlet of the inside tube. The heater coil cover outlet 39 is preferably the same diameter as the outlet opening 43 to allow vapor flow through the outlet of the inside tube which can be formed as the heater coil cover outlet 39. The heater coil cover outlet 39 is in fluid communication with the outlet opening 43 so that the user can suck out the vapor by starting a vapor flow through both openings. The heater coil cover 38 can have an annular groove that fits to an internal circumferential surface of the vapor module inside tube 35 in a snug fit.

The vapor module inside tube 35 preferably has a pair of heater coil gaps 37. The heater coil gap is formed as a slot in the side wall of the vapor module inside tube 35. A heater coil 36 is mounted between the heater coil gaps. The airflow enters through the heater coil gap 37 and exits through the heater coil cover outlet 39. The heater coil 36 is energized and gets hot when the vapor module inside tube 35 is properly installed so that it is biased against the battery module and the user depresses the switch formed as the outlet plunger 42. The first battery contact 22 is spring biased so that it pushes against the inside tube first electrical contact 54. The inside tube first electrical contact 54 is electrically insulated from the inside tube at the inside tube insulator 55.

A first end of the heater coil 36 is connected to the inside tube first electrical contact 54 and a second end of the heater coil 36 is connected to the inside tube second electrical contact 53. The inside tube second electrical contact 53 is at a top surface of the heater coil cover outlet 39. More than one heater coil 36 can be implemented and mounted inside the vapor module inside tube 35. The heater coil 36 is mounted with a horizontal configuration so that the heater coil opening faces the heater coil gap 37. When the heater coil 36 is installed, a wick strand 52 can be passed through the heater coil 36, or can be placed near the heater coil 36 so that a liquid drawn in from the wick strand 52 can be vaporized and can exit the vaporization chamber through the heater coil cover outlet 39. The wick strand 52 can be formed from a fibrous material and can be made into a string or cord like wick. The inside tube seal 56 is mounted to the inside tube seal flange 58. The wick wrapper 51 can act as a reservoir for holding a quantity of liquid to be vaporized. The wick wrapper 51 can be formed as a fabric or fibrous sheet that wraps around the vapor module inside tube 35. The wick wrapper 51 has a fiber density that is compatible with the viscosity of a liquid, also called juice, that is to be vaporized. A user can add more juice by using a dropper to add liquid to the wick wrapper 51. The air inlet 31 faces the wick wrapper 51 so that air is drawn through the wick wrapper 51 before being heated at the heater coil 36.

A coil spring in the battery module biases the vapor module inside tube 35 against the first battery contact 22 and the second battery contact 23 so that the first battery contact 22 and the second battery contact 23 makes a good electrical contact with the inside tube first inside tube electrical contact 54 and the outside tube that is ultimately electrically connected to the inside tube second electrical contact 53. The outlet plunger 42 has an outlet plunger outside flange 44 that abuts against the outlet base 41 so that the outlet base 41 minutes the motion of the outlet plunger 42. The outlet plunger 42 can be formed as a tube of sufficient length for a user to inhale through the outlet opening 43. The outlet base thread 45 is preferably right-handed as is the vapor module battery thread 32. The outside tube insulator 61 can be formed as a plastic ring that mounts to the vapor module outside tube 34.

The vapor module inside tube 35 is mounted inside the outside housing of the vapor module 30 by securing the inside tube plastic nut 57 to the threaded surface of the inside tube second electrical contact 53. The plastic nut 57 is an insulated connector that also physically secures the base of the vapor module inside tube 35 to the vapor module 30. The plastic nut 57 can be hand tightened so that the inside tube seal 56 that is mounted under the inside tube seal flange 58 will press against a lower circular shaped surface of the vapor module 32 form an airtight seal to prevent vapor from entering the battery adapter socket 21.

The user operates the vapor generator using the outlet plunger 42 as an electrical switch. Preferably, a coil spring is mounted inside the outlet plunger 42 so that the outlet plunger 42 is biased outward toward the user. The user can depress the outlet plunger using fingers or lips.

Depressing the outlet plunger 42 completes the electrical circuit when the outlet plunger inside flange 46 touches the heater coil cover 38, and also completes the vapor channel connection so that the outlet opening 43 meets the heater coil cover outlet 39. The first battery contact 22 has an electrical connection with the inside tube first electrical contact 54.

The electrical connections and circuit has a coaxial configuration. The first battery contact 22 is located on the axis of the vapor generator tube along with the inside tube first electrical contact 54. On the other hand, the second battery contact 23 makes an electrical connection with the outside tube of the vapor module 30. The outside tube is insulated from the inside tube by the outside tube insulator 61. The second battery contact 23 then transmits the electricity to the outlet module 40 so that when the outlet plunger inside flange 46 touches the vapor module inside tube 35, the circuit is completed and the electricity passes along the vapor module inside tube 35 to the inside tube seal flange 58 and then to the heater coils 36. Since the inside tube second electrical contact 53 is at a top surface of the heater coil cover outlet 39, the top surface of the heater coil cover outlet 39 should be made as a conductive material, preferably metal. Similarly, the outlet plunger inside flange 46 should be made as a conductive material so that it makes good electrical contact with the top surface of the heater coil cover outlet 39.

The invention claimed is:

1. A vapor generator comprising:

a. a battery module, wherein the battery module has a battery adapter socket at an end of the battery module, wherein the battery adapter socket has a battery adapter socket first electrical contact and a battery adapter socket second electrical contact;

b. a vapor module connected to the battery adapter socket, wherein the vapor module comprises a vapor module outside tube;

c. a vapor module inside tube mounted within the vapor module outside tube, wherein the vapor module inside tube has an inside tube first electrical contact, and an inside tube second electrical contact, wherein the inside tube first electrical contact is insulated from the inside tube second electrical contact;

d. a heater coil installed inside the vapor module inside tube, wherein the inside tube first electrical contact contacts the battery adapter socket first electrical contact, and wherein the inside tube second electrical contact contacts the battery adapter socket second electrical contact when the heater coil is in electrical connection with the battery module;

e. an outlet module, wherein the outlet module has an outlet plunger, wherein the outlet plunger is electrically connected to the vapor module outside tube, wherein the vapor module outside tube is electrically connected to the second battery contact, wherein the outlet plunger is mounted to translate on the outlet module so that the outlet plunger has an engaged position that contacts the inside tube second electrical contact to activate the heater coil, wherein the outlet plunger has a disengaged position when the outlet plunger does not contact the inside tube second electrical contact, wherein the outlet module is an electrical switch, and wherein the outlet module further includes an outlet opening that makes a fluid connection with an outlet of the vapor module inside tube when the outlet module is in the engaged position.

2. The vapor generator of claim 1, wherein the vapor module outside tube has at least one air inlet disposed on a sidewall of the vapor module outside tube.

3. The vapor generator of claim 1, wherein the vapor module inside tube has a second heater coil and a heater coil gap disposed on a sidewall of the vapor module inside tube.

4. The vapor generator of claim 1, wherein the vapor module inside tube has a second heater coil.

5. The vapor generator of claim 1, wherein a heater coil gap is disposed on a sidewall of the vapor module inside tube.

6. The vapor generator of claim 1, wherein the vapor module inside tube further comprises a wick strand passing across the heater coil, and a wick wrapper wrapping around the wick strand.

7. The vapor generator of claim 1, wherein the vapor module inside tube is insulated from the vapor module outside tube at an outside tube insulator formed on the outside tube, and also at an inside tube seal formed on the inside tube.

8. The vapor generator of claim 1, wherein the vapor module inside tube is secured to the vapor module outside tube using an inside tube plastic nut.

9. The vapor generator of claim 1, wherein the vapor module outside tube has a heater coil cover with a heater coil cover top surface, wherein the heater coil cover top surface makes electrical connection with an outlet plunger inside flange formed on the outlet plunger.

10. The vapor generator of claim 9, wherein the vapor module outside tube has at least one air inlet disposed on a sidewall of the vapor module outside tube.

11. The vapor generator of claim 9, wherein the vapor module inside tube has a second heater coil and a heater coil gap disposed on a sidewall of the vapor module inside tube.

12. The vapor generator of claim 9, wherein the vapor module inside tube has a second heater coil.

13. The vapor generator of claim 9, wherein a heater coil gap is disposed on a sidewall of the vapor module inside tube.

14. The vapor generator of claim 9, wherein the vapor module inside tube further comprises a wick strand passing across the heater coil, and a wick wrapper wrapping around the wick strand.

15. The vapor generator of claim 9, wherein the vapor module inside tube is insulated from the vapor module outside tube at an outside tube insulator formed on the outside tube, and also at an inside tube seal formed on the inside tube.

16. The vapor generator of claim 9, wherein the vapor module inside tube is secured to the vapor module outside tube using an inside tube plastic nut.

* * * * *